US011406566B2

(12) United States Patent
Lee

(10) Patent No.: US 11,406,566 B2
(45) Date of Patent: Aug. 9, 2022

(54) PILL CUTTER

(71) Applicant: E-LINK PLASTIC & METAL INDUSTRIAL CO., LTD., New Taipei (TW)

(72) Inventor: Cheng-Hua Lee, New Taipei (TW)

(73) Assignee: E-LINK PLASTIC & METAL INDUSTRIAL CO., LTD., New Taipei (TW)

( * ) Notice: Subject to any disclaimer, the term of this patent is extended or adjusted under 35 U.S.C. 154(b) by 291 days.

(21) Appl. No.: 16/921,237

(22) Filed: Jul. 6, 2020

(65) Prior Publication Data

US 2022/0000719 A1 Jan. 6, 2022

(51) Int. Cl.
*A61J 7/00* (2006.01)
*A61J 1/03* (2006.01)

(52) U.S. Cl.
CPC ..... *A61J 7/0007* (2013.01); *A61J 1/03* (2013.01); *Y10T 225/371* (2015.04)

(58) Field of Classification Search
CPC ..... Y10T 225/386; Y10T 225/371; Y10T 225/379; Y10T 225/30; A61J 7/0007; A61J 1/03; B26F 3/00
See application file for complete search history.

(56) References Cited

U.S. PATENT DOCUMENTS

2002/0179669 A1* 12/2002 Buckley ..... B26D 1/30 225/93
2014/0311304 A1* 10/2014 Noble ..... A61J 7/0007 83/13
2016/0367441 A1* 12/2016 Martin ..... B26F 3/00
2019/0105232 A1* 4/2019 Fallah ..... A61J 7/0007
2021/0220223 A1* 7/2021 Triplett ..... A61J 7/0007

* cited by examiner

*Primary Examiner* — Phong H Nguyen
(74) *Attorney, Agent, or Firm* — Rabin & Berdo, P.C.

(57) ABSTRACT

A pill cutter has a base, a clamping assembly, a connecting unit, a cover, and a cutting assembly. The clamping assembly has two first clamping units moveably mounted on the base. The connecting unit has a base end moveably mounted on the base and a cover end pivotally mounted on the cover. The cutting assembly has a pressing unit moveably mounted on the cover and a blade securely mounted on the pressing unit. When the cover is opened, the connecting unit moves along with the cover and pulls the two first clamping units away from each other. When the cover is closed, the two first clamping units move toward each other by springs to stably clamp a pill in any shape or size. Therefore, a user can simply press the pressing unit to move the blade to safely cut the clamped pill.

20 Claims, 14 Drawing Sheets

PILL CUTTER

BACKGROUND OF THE INVENTION

1. Field of the Invention

The present invention relates to a medical device, especially to a pill cutter that is capable of clamping and cutting a pill safely in any standardized size.

2. Description of the Prior Arts

Buying prescribed medicines in pharmacies might be quite a daily routine for a patient. The prescribed medicines are usually made into pills, mostly in standardized sizes. Therefore, sometimes the patient might need to cut a pill before taking the pill in order to match the prescribed dosage.

However, some of the pills are formed into a round shape with curved surfaces such that the patient cannot hold the pill stably on a cutting board with fingers and might be injured when cutting a round pill directly with a knife.

In addition, since a volume of a pill is usually small, cutting the pill to exactly two halves is difficult for the patient, and an inaccurate dose will definitely affect the curing efficacy and the side effect.

In summary, since cutting a pill directly with a knife on a cutting board is not only dangerous but also inaccurate in dosing, a device for stably clamping and safely cutting a pill in any standardized size is needed.

To overcome the shortcomings, the present invention provides a pill cutter to mitigate or obviate the aforementioned problems.

SUMMARY OF THE INVENTION

The main objective of the present invention is to provide a pill cutter that is capable of clamping and cutting a pill safely in any standardized size.

The pill cutter has a base, a clamping assembly, a connecting unit, and a cutting assembly. The base has a cutting surface, two first tracks, and a connecting track. The cutting surface has a pill area. The first tracks are mounted on the cutting surface, is located respectively on two opposite sides of the pill area, and extend toward the pill area. The connecting track is mounted on the cutting surface. The clamping assembly has two first clamping units, two clamping elastic units, a gear, two racks, and an abutting unit. The two first clamping units are respectively mounted on the two first tracks of the base. The two first clamping units are capable of moving along the two first tracks toward or away from the pill area. The two clamping elastic units are respectively connected to the two first clamping units. Each of the two clamping elastic units is connected between the corresponding first clamping unit and the base. The two clamping elastic units are respectively configured to move the two first clamping units toward the pill area. The gear is rotatably mounted on the base. The two racks are respectively securely connected to the two first clamping units. The two racks engage with the gear and are respectively located on two opposite sides of the gear so that the two first clamping units move along with each other respectively in two reverse directions. The abutting unit is securely mounted on one of the two first clamping units. The connecting unit has a base end, a cover end, and an abutting segment. The base end is moveably mounted on the connecting track of the base. The abutting segment selectively abuts the abutting unit of the clamping assembly. The cover selectively covers the cutting surface of the base, and has an outer side, an inner side, a first pivoting segment, and a second pivoting segment. The inner side is opposite to the outer side. The first pivoting segment is pivotally connected to the base. The second pivoting segment is located on the inner side and is pivotally connected to the cover end of the connecting unit. During the pivoting of the cover relative to the base, the second pivoting segment moves the connecting unit, then the connecting unit moves the corresponding first clamping unit via the abutting segment and the abutting unit, then said first clamping unit moves the other first clamping unit via the gear and the two racks, and thus the two first clamping units are moved away from the pill area. The cutting assembly has a pressing unit, a blade, and at least one cutting elastic unit. The pressing unit is moveably mounted on the cover and located on the outer side. The blade is securely mounted on the pressing unit and moves along with the pressing unit. The blade is capable of moving toward the pill area of the cutting surface when the cover is closed. The at least one cutting elastic unit is connected between the pressing unit and the cover. The at least one cutting elastic unit is configured to move the blade away from the cutting surface.

When a user opens the cover, the second pivoting segment moves relative to the first pivoting segment and the connecting unit moves along with the second pivoting segment. Then, the abutting segment of the connecting unit abuts the abutting unit, and the connecting unit pulls one of the two first clamping units away from the pill area, and the other first clamping unit is synchronously moved away from the pill area at the same time by the gear and the two racks. After the cover is completely opened, the two first clamping units are moved away from each other and a pill can be placed on the pill area of the cutting surface. Then, when the user closes the cover, the connecting unit is no longer holding the two first clamping units and the two clamping elastic units push the two first clamping units toward the pill area to clamp the pill. After then, the user can press the pressing unit to move the blade downward toward the pill area to cut the pill.

With the two first clamping units moving along the two first tracks, the clamping assembly is capable of clamping and fixing a pill in any standardized size. With the cutting surface supporting a bottom of the pill and the two first clamping units respectively abutting two horizontal opposite sides of the pill, the clamping assembly of the present invention is capable of stably clamping the pill.

With the pressing unit and the blade moveably mounted on the cover, the user can simply press the pressing unit to cut the pill clamped between the two clamping units. Therefore, the user can safely cut the pill without using a knife while the fingers are holding the pill.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
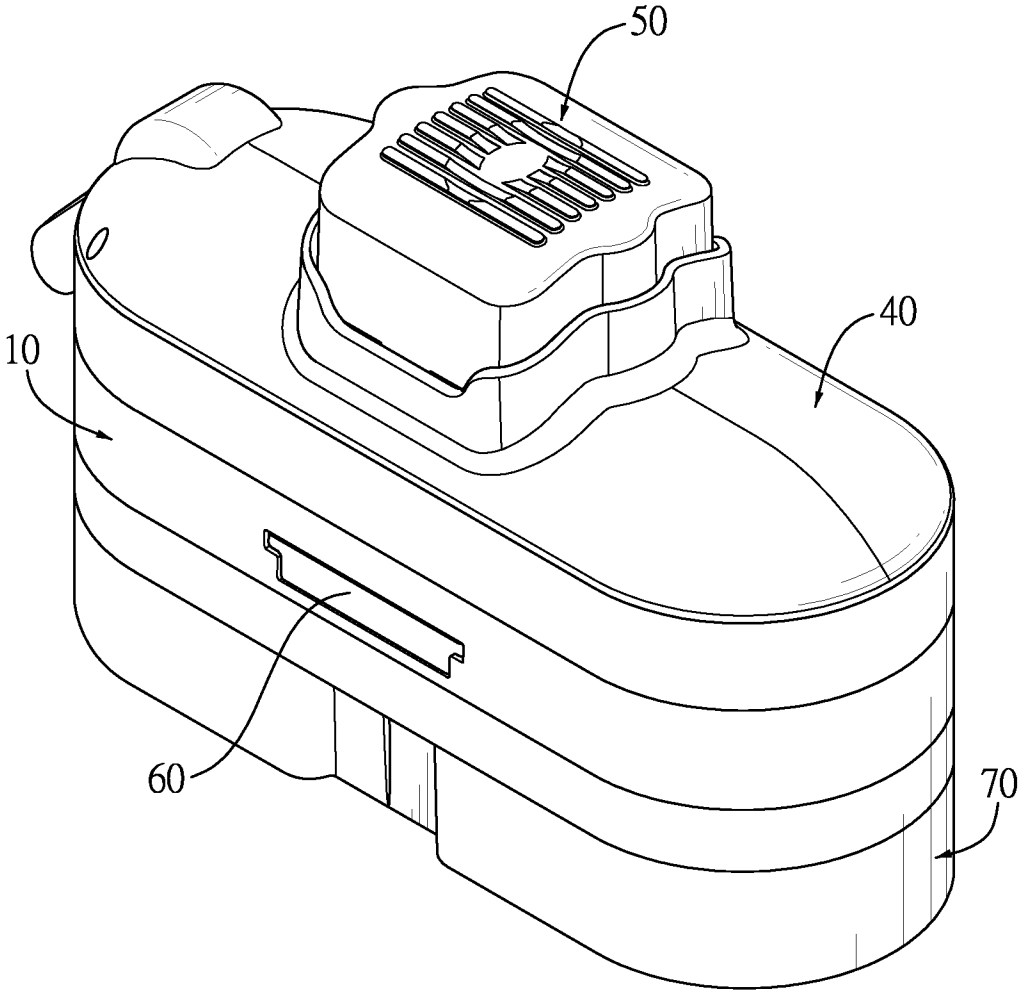
FIG. 1 is a perspective view of a first embodiment of a pill cutter in accordance with the present invention.
Figure 2:
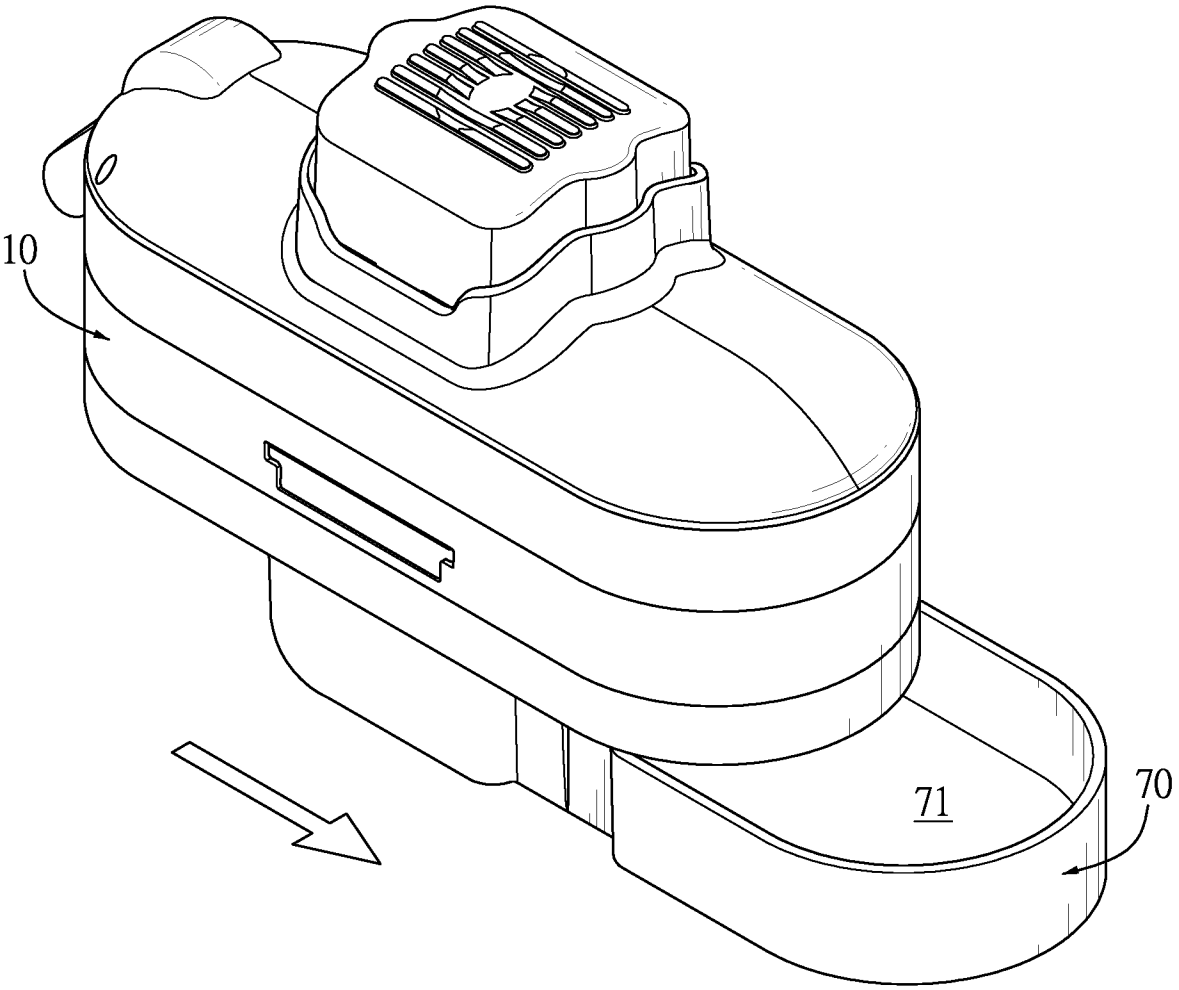
FIG. 2 is another perspective view of the first embodiment of the pill cutter in FIG. 1, showing the operation of the pill box.
Figure 5:
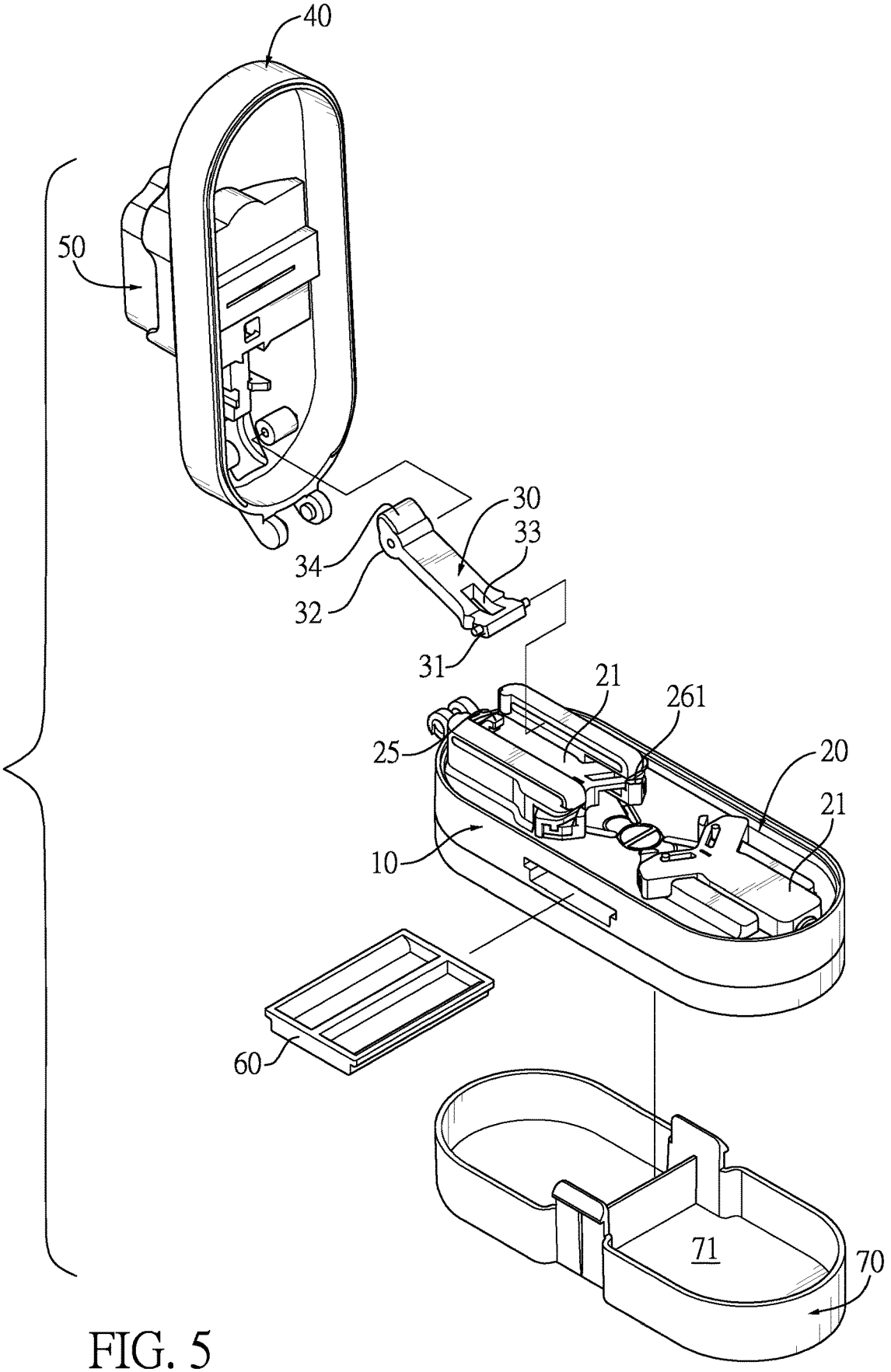
FIG. 5 is an exploded view of the first embodiment of the pill cutter in FIG. 1, showing the base, the connecting unit, the cover, the powder drawer, and the pill box.

With reference to FIGS. 1, 2, and 5, in the first embodiment, a pill cutter in accordance with the present invention comprises a base 10, a clamping assembly 20, a connecting unit 30, a cover 40, a cutting assembly 50, a powder drawer 60, and a pill box 70.

Figure 3:
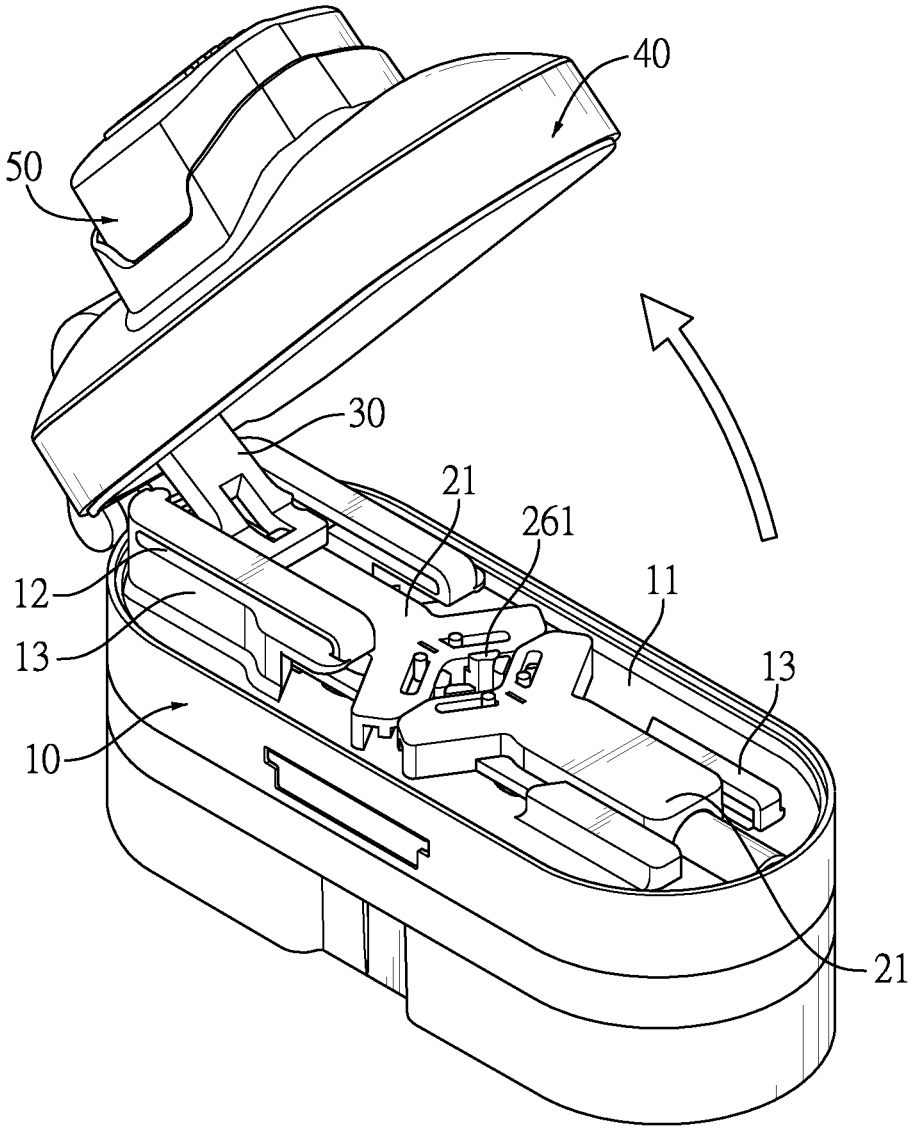
FIGS. 3 and 4 are perspective operational views of the first embodiment of the pill cutter in FIG. 1, showing the operation of the cover.
Figure 4:
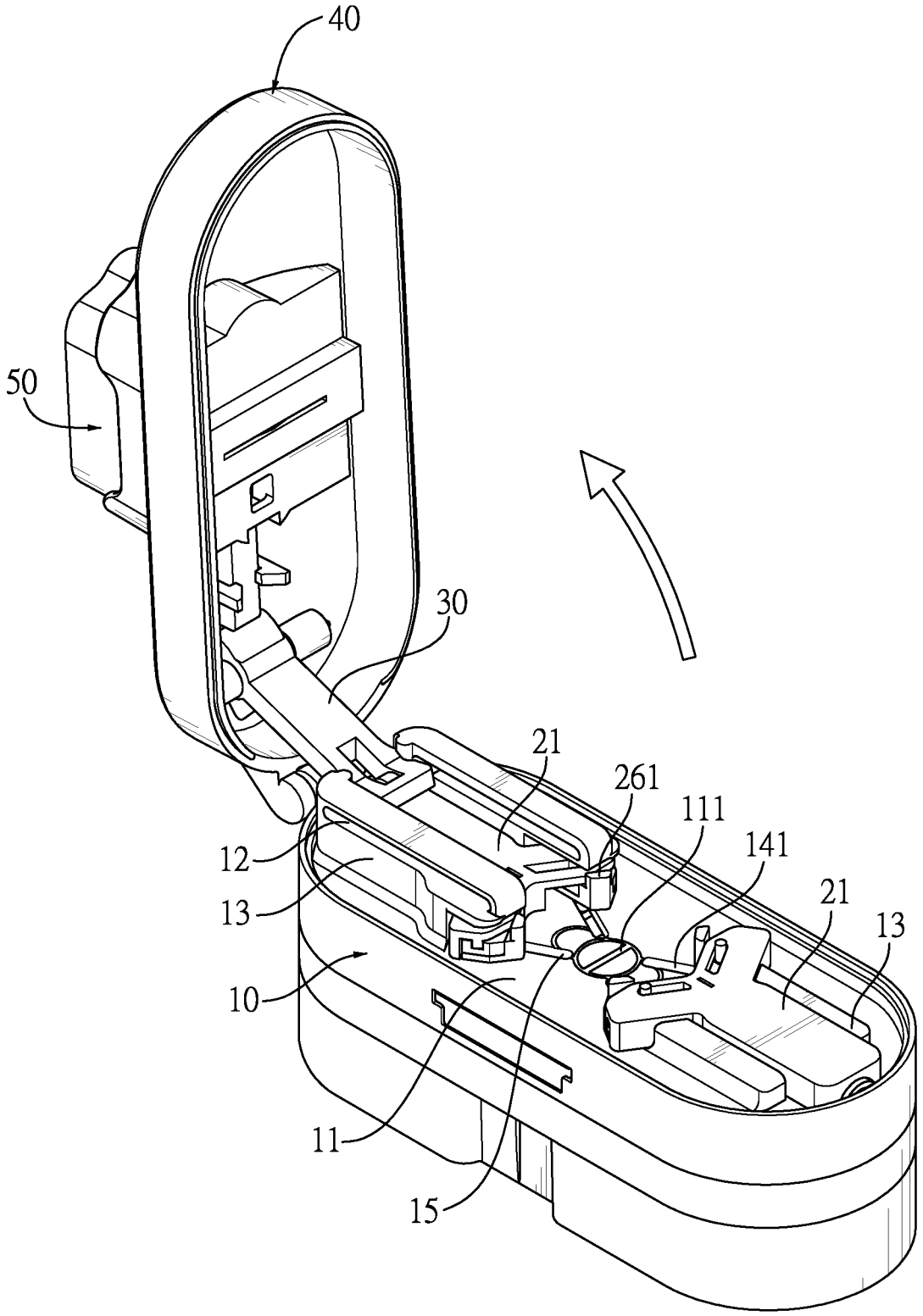
Figure 7:
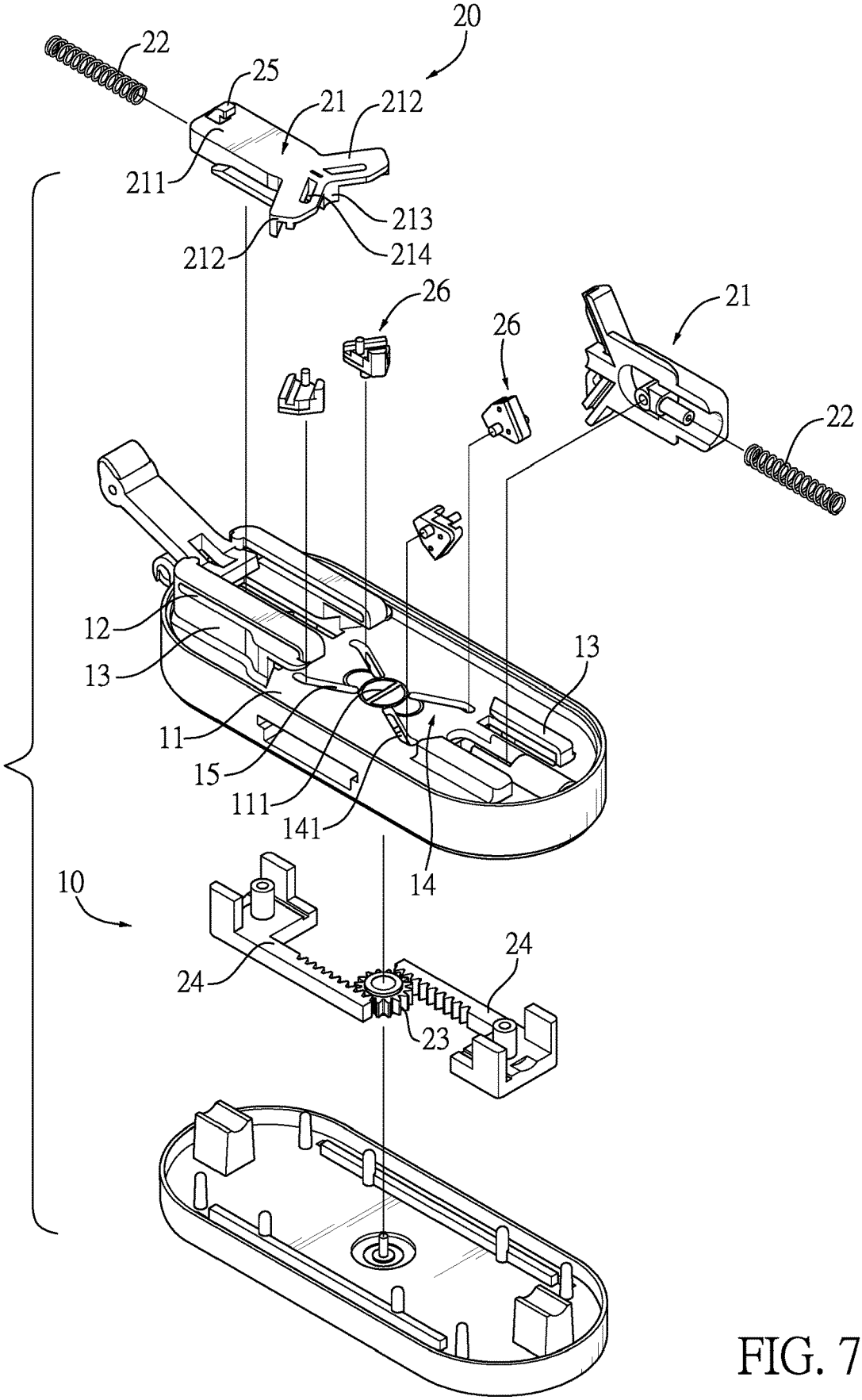
FIG. 7 is still another exploded view of the first embodiment of the pill cutter in FIG. 1, showing the base and the clamping assembly.

With further reference to FIGS. 3, 4, and 7, the base 10 has a cutting surface 11, a connecting track 12, two first tracks 13, two second track assemblies 14, and a powder hole 15.

The cutting surface 11 has a pill area 111.

The connecting track 12 is mounted on the cutting surface 11.

The two first tracks 13 are mounted on the cutting surface 11, are located respectively on two opposite sides of the pill area 111, and extend toward the pill area 111.

The two second track assemblies 14 are mounted on the cutting surface 11. The two second track assemblies 14 are respectively located on the two opposite sides of the pill area 111, and each of the two second track assemblies 14 has two second tracks 141. The two second tracks 141 extend toward the pill area 111 and are inclined to the corresponding first track 13. The two second tracks 141 approach each other in a direction toward the pill area 111. In other words, the four second tracks 141 of the two second track assemblies 14 are arranged in an X shape, and the pill area 111 is in the center of the X.

The powder hole 15 is formed through the cutting surface 11. Powder formed by cutting a pill can fall through the powder hole 15 into the powder drawer 60. Specifically, in the first embodiment, the two second tracks 141 of each of the two second track assemblies 14 are two elongated holes formed through the cutting surface 11, and therefore the second track 141 can be used as the powder hole 15. In other words, since the second track 141 is formed through the cutting surface 11, the powder hole 15 is no longer needed in the first embodiment. But in other embodiments, the second tracks 141 can also be implemented as protruding from the cutting surface 11, and the powder hole 15 can be formed for use with the powder drawer 60.

Figure 8:
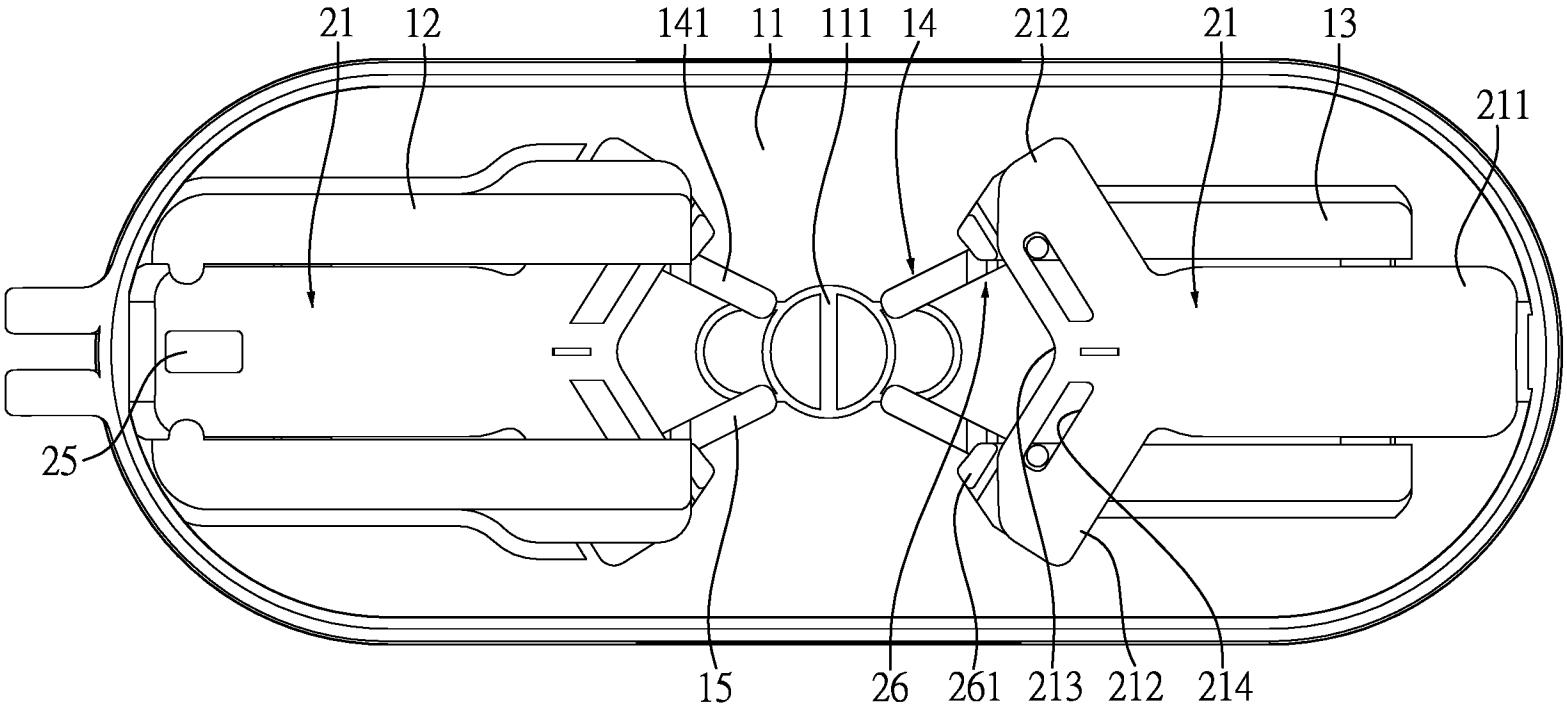
FIGS. 8 and 9 are top views of the first embodiment of the pill cutter in FIG. 1, showing the operation of the clamping assembly.
Figure 9:
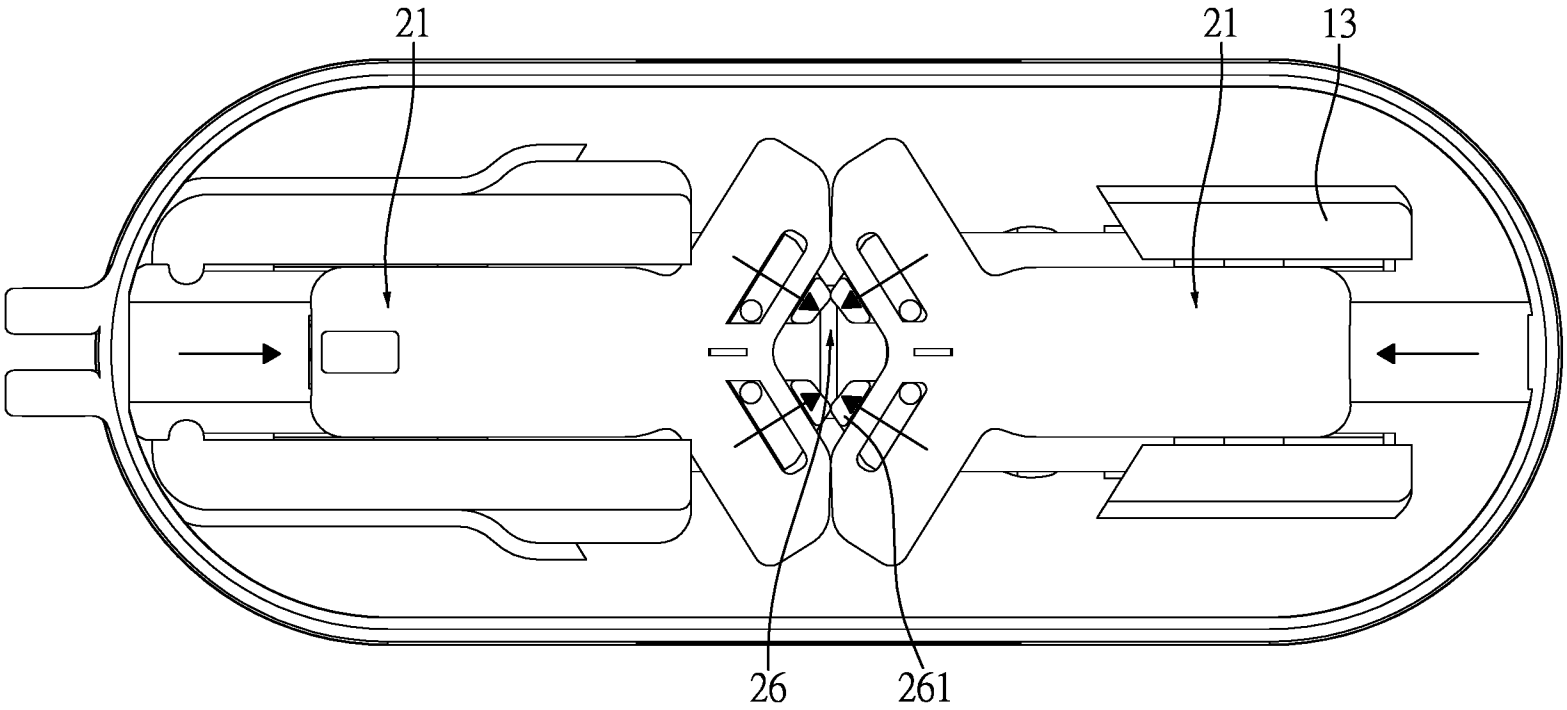

With further reference to FIGS. 7, 8, and 9, the clamping assembly 20 has two first clamping units 21, two clamping elastic units 22, a gear 23, two racks 24, an abutting unit 25, and two second clamping unit assemblies 26.

The two first clamping units 21 are respectively mounted on the two first tracks 13 of the base 10. The two first clamping units 21 are capable of moving along the two first tracks 13 toward or away from the pill area 111. Specifically, in the first embodiment, the two first clamping units 21 of the clamping assembly 20 selectively abut each other, and each of the two first clamping units 21 has a track segment 211, two clamping segments 212, a clamping groove 213, and two sliding grooves 214.

The track segment 211 is movably mounted on the corresponding first track 13.

The two clamping segments 212 protrude from an end, which is toward the pill area 111, of the track segment 211. When the two first clamping units 21 abut each other, the two clamping segments 212 on one of the two first clamping units 21 respectively abut the two clamping segments 212 on the other first clamping unit 21.

The clamping groove 213 is formed between the two clamping segments 212. The two clamping grooves 213 of the two first clamping units 21 are aligned to each other.

The two sliding grooves 214 are respectively formed in the two clamping segments 212. The two sliding grooves 214 extend away from each other in a direction toward the pill area 111.

The two clamping elastic units 22 are respectively connected to the two first clamping units 21. Each of the two clamping elastic units 22 is connected between the corresponding first clamping unit 21 and the base 10. The two clamping elastic units 22 are configured to respectively move the two first clamping units 21 toward the pill area 111.

The gear 23 is rotatably mounted on the base 10.

The two racks 24 are respectively securely connected to the two first clamping units 21. The two racks 24 engage with the gear 23 and are respectively located on two opposite sides of the gear 23 such that the two first clamping units 21 move along with each other respectively in two reverse directions.

The abutting unit 25 is securely mounted on one of the two first clamping units 21. Specifically, in the first embodiment, the abutting unit 25 is, but not limited to, a protrusion formed integrally on said first clamping unit 21.

The two second clamping unit assemblies 26 are respectively mounted on the two second track assemblies 14 and are respectively mounted on the two first clamping units 21. Each of the two second clamping unit assemblies 26 has two second clamping units 261.

The two second clamping units 261 are respectively moveably mounted on the two second tracks 141 of the corresponding second track assembly 14, and are respectively moveably mounted on the two sliding grooves 214 of the corresponding first clamping unit 21. When said first clamping unit 21 moves toward the pill area 111, the two second clamping units 261 of said second clamping unit assembly 26 move along the two second tracks 141 and the two sliding grooves 214 toward each other. When said first clamping unit moves away from the pill area 111, the two second clamping units 261 of said second clamping unit assembly 26 move along the two second tracks 141 and the two sliding grooves 214 away from each other.

The two second clamping units 261 are used to clamp a pill in a particular shape (such as an elongated shape) or a pill in a very small size. But the second clamping units 261 are not necessary since the clamping groove 213 can be smaller in another embodiment, and therefore the base 10 can be implemented without the second tracks 141, and the clamping assembly 20 can be implemented without the sliding grooves 214.

With further reference to FIG. 5, the connecting unit 30 has a base end 31, a cover end 32, an abutting segment 33, and a safety segment 34. The base end 31 is moveably mounted on the connecting track 12 of the base 10. The abutting segment 33 selectively abuts the abutting unit 25 of the clamping assembly 20. Specifically, in the first embodiment, the abutting segment 33 is, but not limited to, a through hole formed through the connecting unit 30, and the protrusive abutting unit 25 is selectively hooked in the through hole and then the first clamping unit 21 is pulled away from the pill area 111 when the cover is opened. The safety segment 34 protrudes from the cover end 32.

Figure 6:
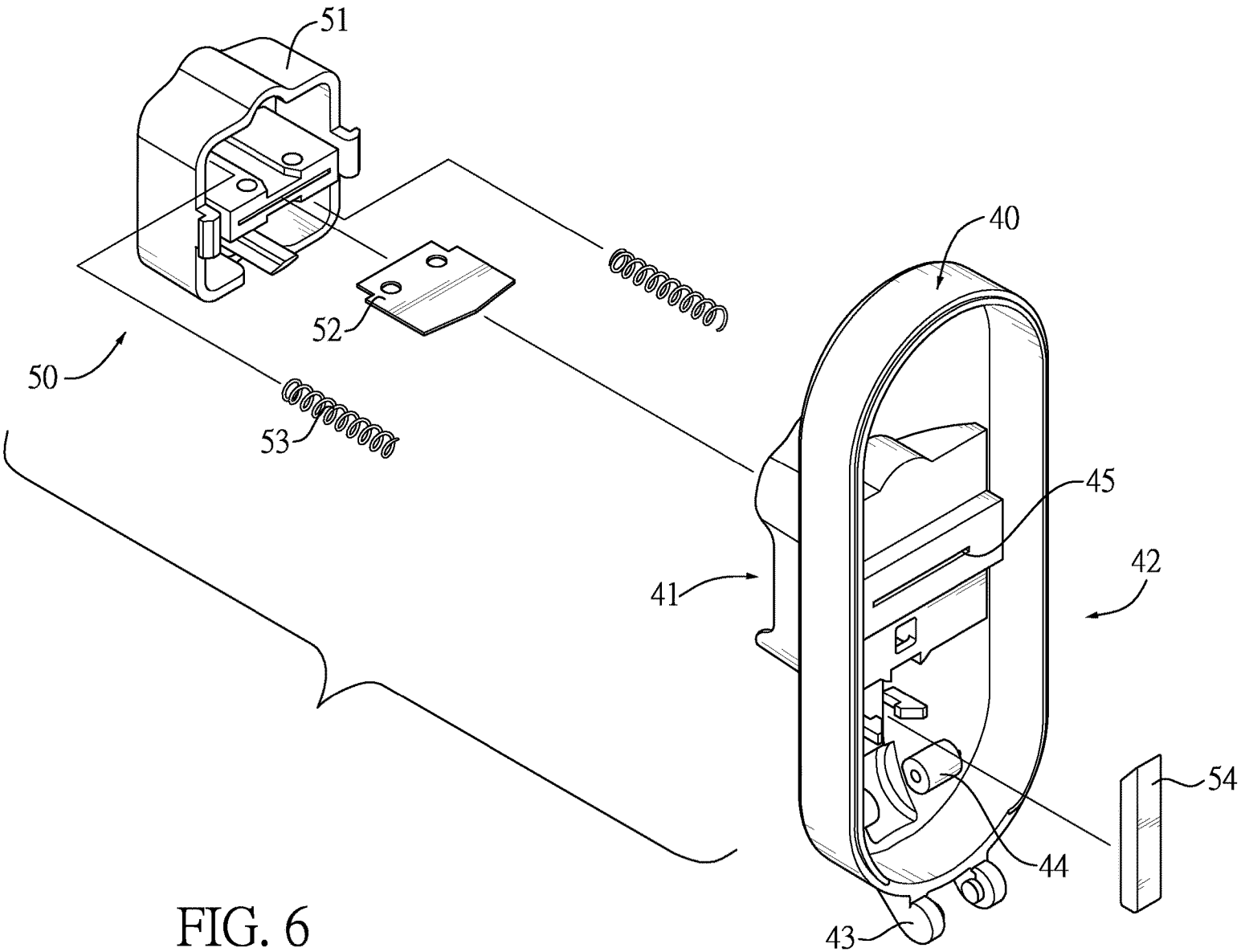
FIG. 6 is another exploded view of the first embodiment of the pill cutter in FIG. 1, showing the cover and the cutting assembly.

With further reference to FIGS. 5 and 6, the cover 40 selectively covers the cutting surface 11 of the base 10 and has an outer side 41, an inner side 42, a first pivoting segment 43, a second pivoting segment 44, and a blade hole 45.

The inner side 42 is opposite to the outer side 41.

The first pivoting segment 43 is pivotally connected to the base 10.

The second pivoting segment 44 is located on the inner side 42 and is pivotally connected to the cover end 32 of the connecting unit 30. During pivoting of the cover 40 relative to the base 10, the second pivoting segment 44 moves the connecting unit 30, then the connecting unit 30 moves the corresponding first clamping unit 21 via the abutting segment 33 and the abutting unit 25, then said first clamping unit 21 moves the other first clamping unit 21 via the gear 23 and the two racks 24, and thus the two first clamping units 21 are moved away from the pill area 111.

Specifically, with further reference to FIGS. 3 to 4 and 8 to 9, when the cover 40 is opened, the second pivoting segment 44 moves relative to the first pivoting segment 43 and the connecting unit 30 moves along with the second pivoting segment 44. Then, the abutting segment 33 of the connecting unit 30 abuts the abutting unit 25, the connecting unit 30 pulls one of the two first clamping units 21 away from the pill area 111, and the other first clamping unit is moved away from the pill area 111 at the same time by the gear 23 and the two racks 24. Therefore, after the cover 40 is completely opened, the two first clamping units 21 are moved away from each other.

The blade hole 45 connects the outer side 41 with the inner side 42.

Figure 10:
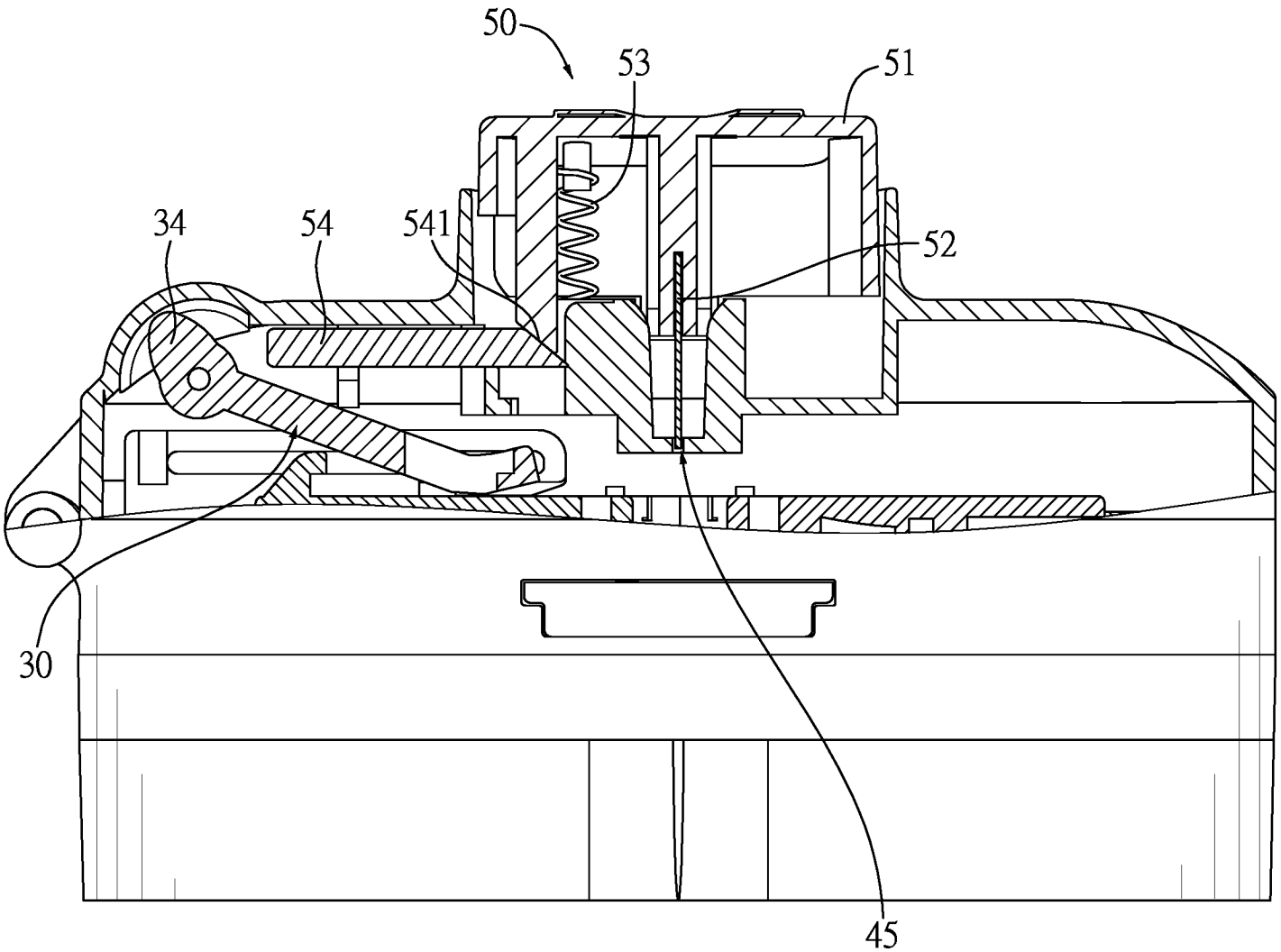
FIGS. 10 and 11 are side views in partial cross section of the first embodiment of the pill cutter in FIG. 1, showing the operation of the cutting assembly.
Figure 11:
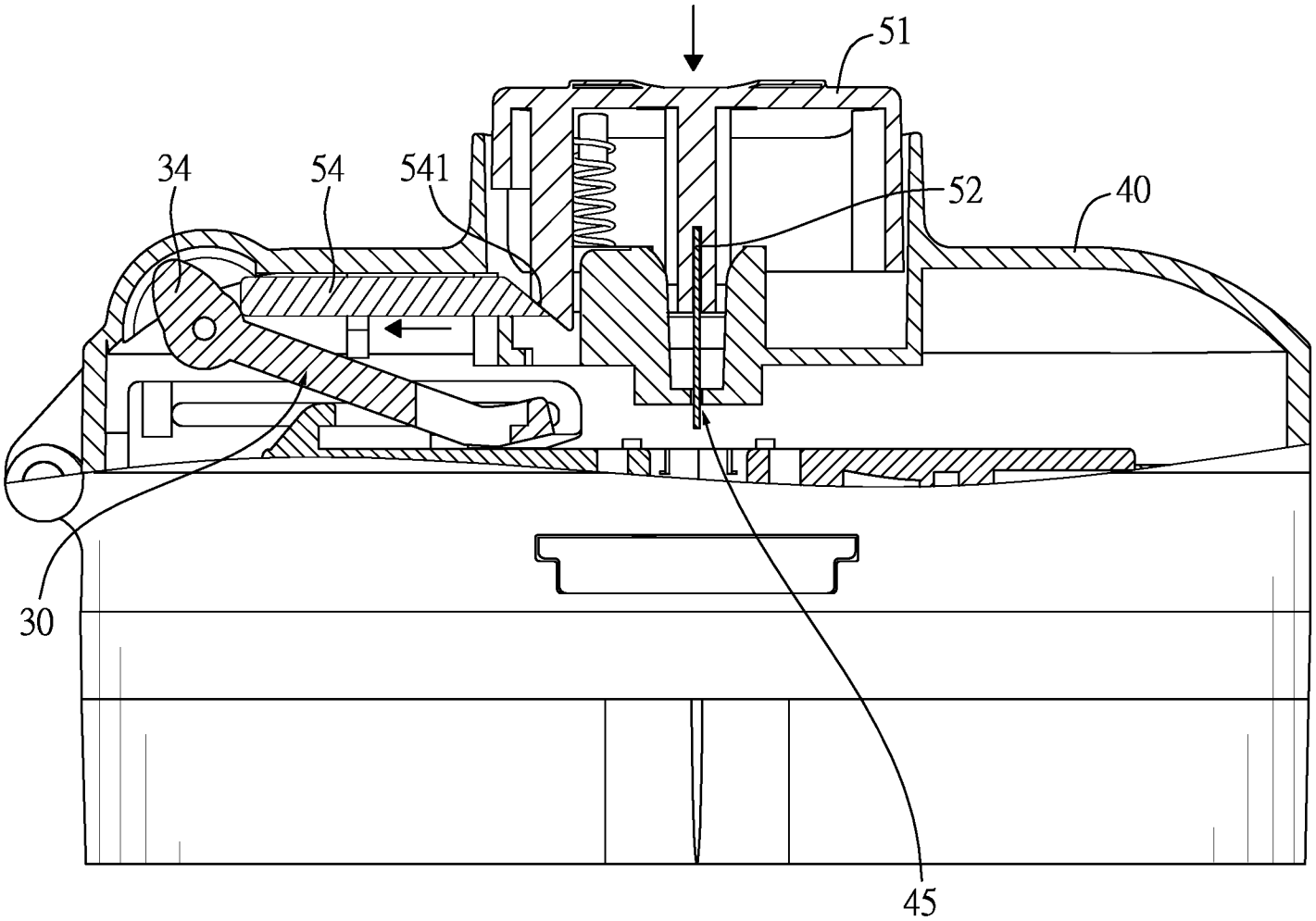

With further reference to FIGS. 6, 10, and 11, the cutting assembly 50 has a pressing unit 51, a blade 52, at least one cutting elastic unit 53, and a latch 54.

The pressing unit 51 is moveably mounted on the cover 40 and is located on the outer side 41.

The blade 52 is securely mounted on the pressing unit 51 and moves along with the pressing unit 51. The blade 52 is capable of moving toward the pill area 111 of the cutting surface 11 when the cover 40 is closed. Specifically, in the first embodiment, the blade 52 is located on the outer side 41 and is capable of moving through the blade hole 45 toward the inner side 42. Therefore, the blade 52 will be hidden behind the cover 40 when the cover 40 is opened. But in another embodiment, the blade 52 can also be located on the inner side 42 and the pressing unit 51 can be moveably mounted through the cover 40 to be connected to the blade 52.

The at least one cutting elastic unit 53 is connected between the pressing unit 51 and the cover 40. The at least one cutting elastic unit 53 is configured to move the blade 52 away from the cutting surface 11 when the cover 40 is closed. In other words, the at least one cutting elastic unit 53 is configured to move the blade 52 through the blade hole 45 toward the outer side 41 to hide the blade 52 behind the cover 40.

Figure 12:
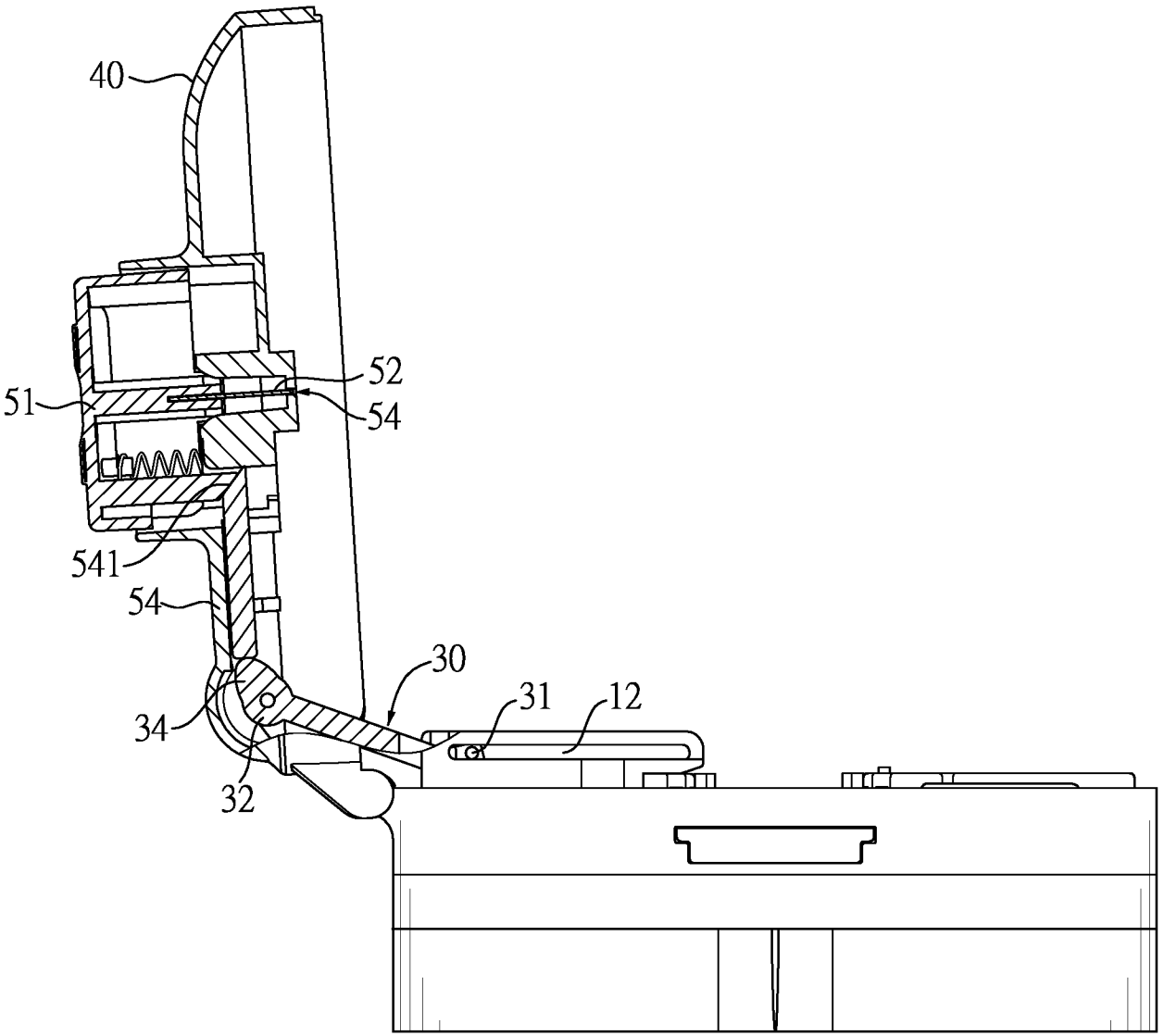
FIG. 12 is another side view in partial cross section of the first embodiment of the pill cutter in FIG. 1, showing the connecting unit stopping the cutting assembly.

The latch 54 is moveably mounted on the cover 40 and has an inclined surface 541. When the pressing unit 51 moves relative to the cover 40, the pressing unit 51 abuts the inclined surface 541 and pushes the latch 54 by sliding relative to the inclined surface 541. With further reference to FIG. 12, when the cover 40 is opened, the safety segment 34 of the connecting unit 30 abuts and stops the latch 54 so that the pressing unit 51 is stuck by the latch 54.

With reference to FIGS. 1 and 5, the powder drawer 60 is detachably mounted on the base 10, is located beneath the cutting surface 11, and corresponds in position to the second tracks 141 and the powder hole 15.

With reference to FIGS. 1 and 2, the pill box 70 is mounted on a bottom of the base 10 and has a storage space 71. The pill box 70 is moveably mounted on the base 10 and is capable of moving relative to the base 10 to open the storage space 71.

Figure 13:
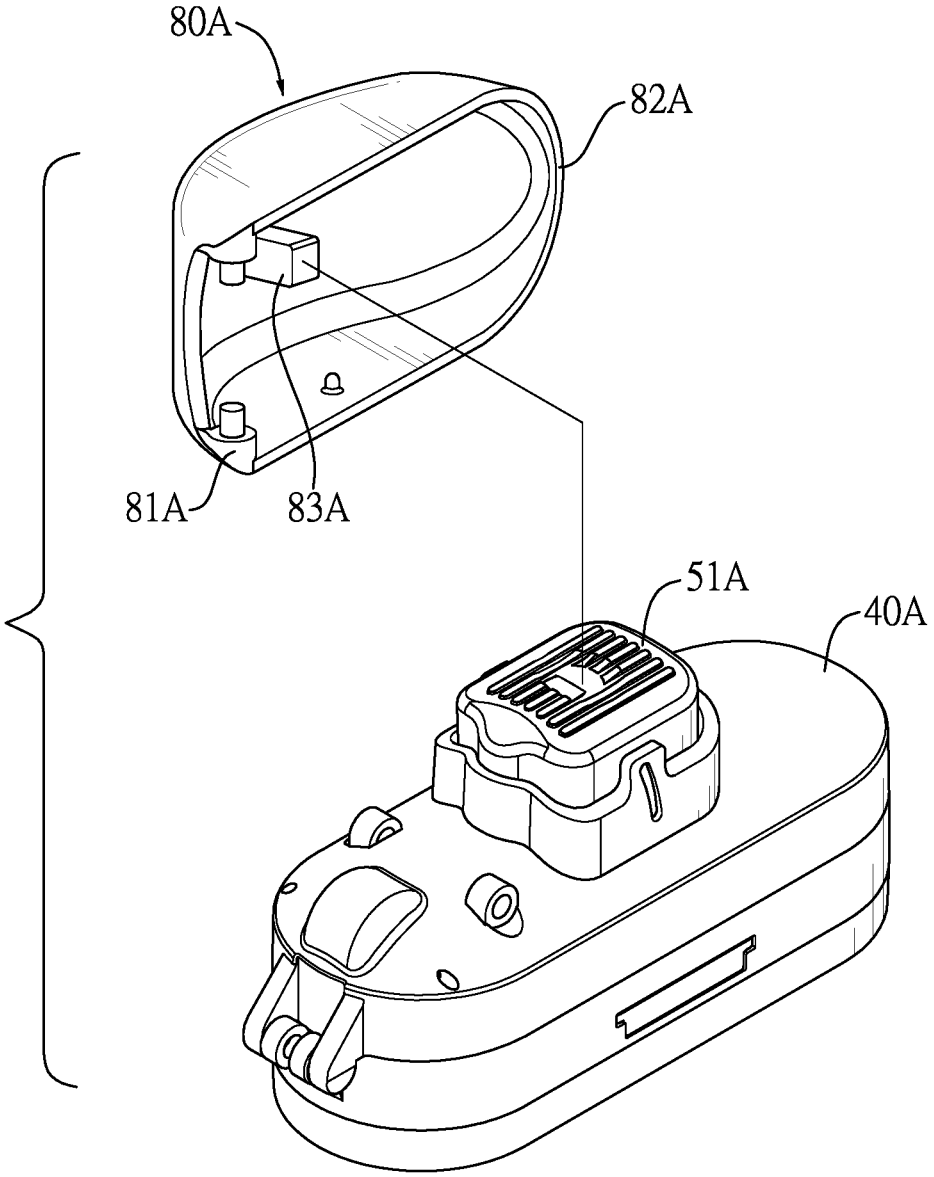
FIG. 13 is an exploded view of a second embodiment of the pill cutter in accordance with the present invention.
Figure 14:
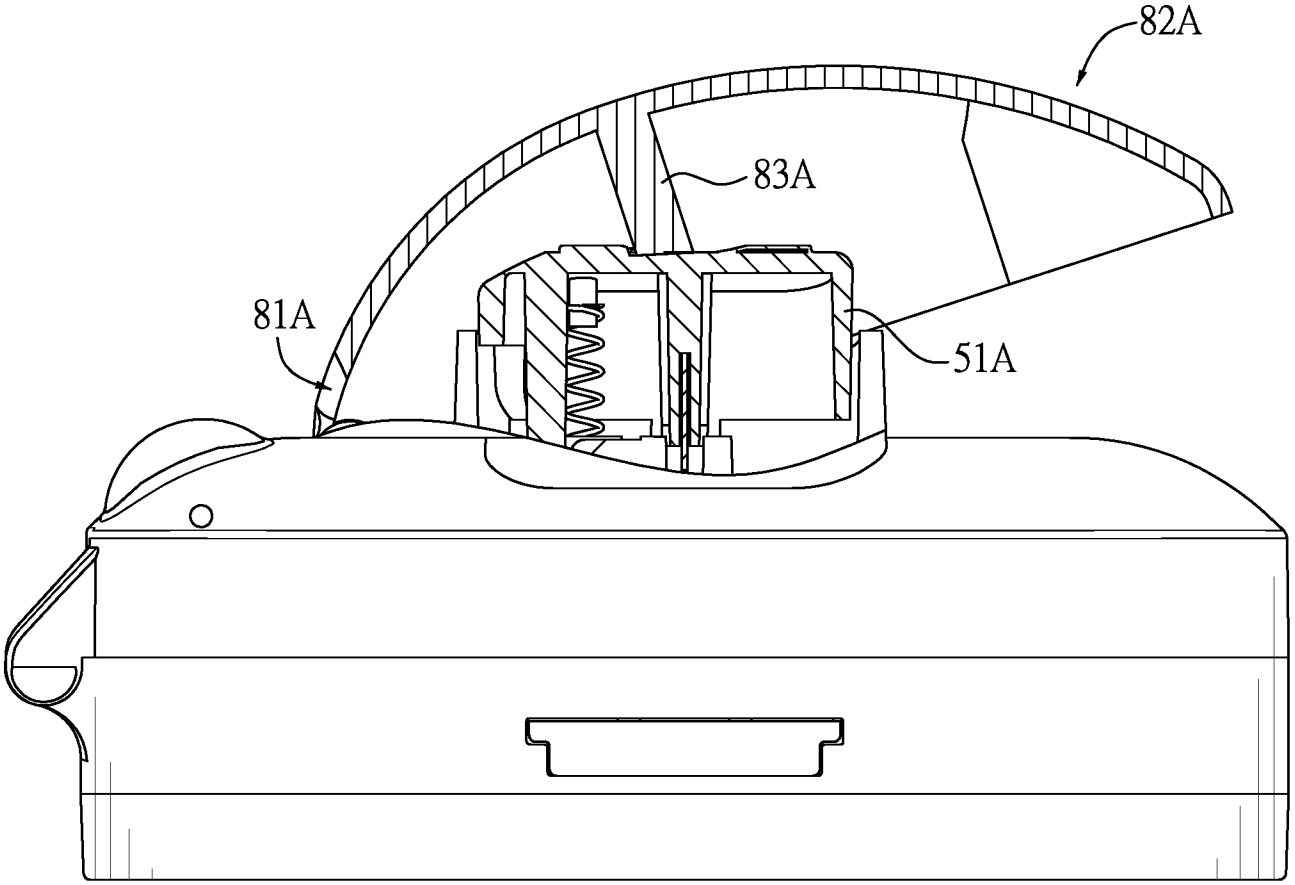
FIG. 14 is a partial side view in cross section of the second embodiment of the pill cutter in FIG. 13.

With reference to FIGS. 13 and 14, in the second embodiment, the pill cutter further has a pushing unit 80A. The pushing unit 80A is located on the outer side 41A of the cover 40A and has a pivoting end 81A, a pressing end 82A, and an abutting part 83A.

The pivoting end 81A is pivotally connected to the cover 40A. The pressing end 82A is opposite to the pivoting end 81A. The abutting part 83A is located between the pivoting end 81A and the pressing end 82A. The abutting part 83A abuts the pressing unit 51A of the cutting assembly so that the pushing unit 80A is capable of pressing the pressing unit 51A during pivoting relative to the cover 40A.

A distance from the pressing end 82A to the pivoting end 81A is longer than a distance from the abutting part 83A to the pivoting end 81A. Therefore, according to the principle of leverage, the user can press the pressing unit 51A more effortlessly by pressing the pressing end 82A of the pushing unit 80A.

When a user opens the cover 40, the second pivoting segment 44 moves relative to the first pivoting segment 43 and the connecting unit 30 moves along with the second pivoting segment 44. Then, the abutting segment 33 of the connecting unit 30 abuts the abutting unit 25, the connecting unit 30 pulls one of the two first clamping units 21 away from the pill area 111, and the other first clamping unit is synchronously moved away from the pill area 111 at the same time by the gear 23 and the two racks 24. After the cover 40 is completely opened, the two first clamping units 21 are moved away from each other and a pill can be placed on the pill area 111 of the cutting surface 11. Then, when the user closes the cover 40, the connecting unit 30 is no longer holding the two first clamping units 21 and the two clamping elastic units 22 push the two first clamping units 21 toward the pill area 111 to clamp the pill. After then, the user can press the pressing unit 51 to move the blade 52 downward toward the pill area 111 to cut the pill.

With the two first clamping units 21 moving along the two first tracks 13, the clamping assembly 20 is capable of clamping and fixing a pill in any standardized size. With the cutting surface 11 supporting a bottom of the pill and the two first clamping units 21 respectively abutting two horizontal opposite sides of the pill, the clamping assembly 20 of the present invention is capable of stably clamping the pill.

With the pressing unit 51 and the blade 52 moveably mounted on the cover 40, the user can simply press the pressing unit 51 to cut the pill clamped between the two clamping units 21. Therefore, the user can safely cut the pill without using a knife while the fingers are holding the pill.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A pill cutter comprising:

a base having a cutting surface having a pill area;

two first tracks mounted on the cutting surface, located respectively on two opposite sides of the pill area, and extending toward the pill area; and a connecting track mounted on the cutting surface;

a clamping assembly having two first clamping units respectively mounted on the two first tracks of the base; the two first clamping units being capable of moving along the two first tracks toward or away from the pill area;

two clamping elastic units respectively connected to the two first clamping units; each of the two clamping elastic units connected between the corresponding first clamping unit and the base; the two clamping elastic units respectively configured to move the two first clamping units toward the pill area;

a gear rotatably mounted on the base;

two racks respectively securely connected to the two first clamping units; the two racks engaging with the gear and respectively located on two opposite sides of the gear such that the two first clamping units move along with each other respectively in two reverse directions; and an abutting unit securely mounted on one of the two first clamping units;

a connecting unit having a base end moveably mounted on the connecting track of the base;

a cover end; and an abutting segment selectively abutting the abutting unit of the clamping assembly;

a cover selectively covering the cutting surface of the base, and having an outer side;

an inner side being opposite to the outer side;

a first pivoting segment pivotally connected to the base; and a second pivoting segment located on the inner side and pivotally connected to the cover end of the connecting unit;

wherein during the pivoting of the cover relative to the base, the second pivoting segment moves the connecting unit, then the connecting unit moves the corresponding first clamping unit via the abutting segment and the abutting unit, then said first clamping unit moves the other first clamping unit via the gear and the two racks, and thus the two first clamping units are moved away from the pill area;

a cutting assembly having a pressing unit moveably mounted on the cover and located on the outer side;

a blade securely mounted on the pressing unit and moving along with the pressing unit; the blade being capable of moving toward the pill area of the cutting surface when the cover is closed; and at least one cutting elastic unit connected between the pressing unit and the cover; the at least one cutting elastic unit configured to move the blade away from the cutting surface.

2. The pill cutter as claimed in claim 1, wherein the two first clamping units of the clamping assembly selectively abut each other.

3. The pill cutter as claimed in claim 2, wherein each of the two first clamping units has a track segment movably mounted on the corresponding first track;

two clamping segments protruding from an end, which is toward the pill area, of the track segment; wherein when the two first clamping units abut each other, the two clamping segments of one of the two first clamping units respectively abut the two clamping segments of the other first clamping unit; and a clamping groove formed between the two clamping segments; the two clamping grooves of the two first clamping units aligned to each other.

4. The pill cutter as claimed in claim 3, wherein the base further has two second track assemblies mounted on the cutting surface; the two second track assemblies respectively located on the two opposite sides of the pill area; each of the two second track assemblies having two second tracks extending toward the pill area and being inclined to the corresponding first track; the two second tracks approaching each other in a direction toward the pill area;

each of the first clamping units of the clamping assembly has two sliding grooves; the two sliding grooves extending away from each other in a direction toward the pill area; the two sliding grooves respectively formed in the two clamping segments;

the clamping assembly further has two second clamping unit assemblies respectively mounted on the two second track assemblies and respectively mounted on the two first clamping units; each of the two second clamping unit assemblies having two second clamping units respectively moveably mounted on the two second tracks of the corresponding second track assembly, and respectively moveably mounted on the two sliding grooves of the corresponding first clamping unit;

wherein when said first clamping unit moves toward the pill area, the two second clamping units of said second clamping unit assembly move along the two second tracks and the two sliding grooves toward each other;

wherein when said first clamping unit moves away from the pill area, the two second clamping units of said second clamping unit assembly move along the two second tracks and the two sliding grooves away from each other.

5. The pill cutter as claimed in claim 4, wherein the cover further has a blade hole connecting the outer side with the inner side;

the blade of the cutting assembly is located on the outer side and is capable of moving through the blade hole toward the inner side; and the at least one cutting elastic unit is configured to move the blade through the blade hole toward the outer side.

6. The pill cutter as claimed in claim 5, wherein the cutting assembly further has a latch moveably mounted on the cover and having an inclined surface; wherein when the pressing unit moves relative to the cover, the pressing unit abuts the inclined surface and pushes the latch by sliding relative to the inclined surface;

the connecting unit further has a safety segment protruding from the cover end; wherein when the cover is opened, the safety segment abuts and stops the latch so that the pressing unit is stuck by the latch.

7. The pill cutter as claimed in claim 6, wherein the base further has a powder hole formed through the cutting surface;

the pill cutter further has a powder drawer detachably mounted on the base, located beneath the cutting surface, and corresponding in position to the powder hole.

8. The pill cutter as claimed in claim 6, wherein the two second tracks of each of the two second track assemblies are two elongated holes formed through the cutting surface;

the pill cutter further has a powder drawer detachably mounted on the base, located beneath the cutting surface, and corresponding in position to the second tracks.

9. The pill cutter as claimed in claim 8, wherein the pill cutter further has a pill box mounted on a bottom of the base and having a storage space.

10. The pill cutter as claimed in claim 9, wherein the pill box is moveably mounted on the base and is capable of moving relative to the base to open the storage space.

11. The pill cutter as claimed in claim 10, wherein the pill cutter further has a pushing unit located on the outer side of the cover and having a pivoting end pivotally connected to the cover;

a pressing end being opposite to the pivoting end; and an abutting part located between the pivoting end and the pressing end; the abutting part abutting the pressing unit of the cutting assembly so that the pushing unit is capable of pressing the pressing unit during pivoting relative to the cover.

12. The pill cutter as claimed in claim 1, wherein each of the two first clamping units has a track segment movably mounted on the corresponding first track;

two clamping segments protruding from an end, which is toward the pill area, of the track segment; and a clamping groove formed between the two clamping segments; the two clamping grooves of the two first clamping units aligned to each other.

13. The pill cutter as claimed in claim 1, wherein the base further has two second track assemblies mounted on the cutting surface; the two second track assemblies respectively located on the two opposite sides of the pill area; each of the two second track assemblies having two second tracks extending toward the pill area and being inclined to the corresponding first track; the two second tracks approaching each other in a direction toward the pill area;

each of the first clamping units of the clamping assembly has two sliding grooves; the two sliding grooves extending away from each other in a direction toward the pill area;

the clamping assembly further has two second clamping unit assemblies respectively mounted on the two second track assemblies and respectively mounted on the two first clamping units; each of the two second clamping unit assemblies having two second clamping units respectively moveably mounted on the two second tracks of the corresponding second track assembly, and respectively moveably mounted on the two sliding grooves of the corresponding first clamping unit;

wherein when said first clamping unit moves toward the pill area, the two second clamping units of said second clamping unit assembly move along the two second tracks and the two sliding grooves toward each other;

wherein when said first clamping unit moves away from the pill area, the two second clamping units of said second clamping unit assembly move along the two second tracks and the two sliding grooves away from each other.

14. The pill cutter as claimed in claim 13, wherein the two second tracks of each of the two second track assemblies are two elongated holes formed through the cutting surface;

the pill cutter further has a powder drawer detachably mounted on the base, located beneath the cutting surface, and corresponding in position to the second tracks.

15. The pill cutter as claimed in claim 1, wherein the cover further has a blade hole connecting the outer side with the inner side;

the blade of the cutting assembly is located on the outer side and is capable of moving through the blade hole toward the inner side; and the at least one cutting elastic unit is configured to move the blade through the blade hole toward the outer side.

16. The pill cutter as claimed in claim 1, wherein the cutting assembly further has a latch moveably mounted on the cover and having an inclined surface; wherein when the pressing unit moves relative to the cover, the pressing unit abuts the inclined surface and pushes the latch by sliding relative to the inclined surface;

the connecting unit further has a safety segment protruding from the cover end; wherein when the cover is opened, the safety segment abuts and stops the latch such that the pressing unit is stuck by the latch.

17. The pill cutter as claimed in claim 1, wherein the base further has a powder hole formed through the cutting surface;

the pill cutter further has a powder drawer detachably mounted on the base, located beneath the cutting surface, and corresponding in position to the powder hole.

18. The pill cutter as claimed in claim 1, wherein the pill cutter further has a pill box mounted on a bottom of the base and having a storage space.

19. The pill cutter as claimed in claim 18, wherein the pill box is moveably mounted on the base and is capable of moving relative to the base to open the storage space.

20. The pill cutter as claimed in claim 1, wherein the pill cutter further has a pushing unit located on the outer side of the cover and having a pivoting end pivotally connected to the cover;

a pressing end being opposite to the pivoting end; and an abutting part located between the pivoting end and the pressing end; the abutting part abutting the pressing unit of the cutting assembly so that the pushing unit is capable of pressing the pressing unit during pivoting relative to the cover.

* * * * *